United States Patent [19]

Hirano

[11] Patent Number: 5,049,044

[45] Date of Patent: Sep. 17, 1991

[54] COMPRESSOR FOR HEAT PUMP AND METHOD OF OPERATING SAID COMPRESSOR

[75] Inventor: Takahisa Hirano, Aichi Pref., Japan

[73] Assignee: Mitsubishi Jukogyo Kabushiki Kaisha, Tokyo, Japan

[21] Appl. No.: 467,130

[22] Filed: Jan. 18, 1990

[30] Foreign Application Priority Data

Mar. 2, 1989 [JP] Japan ..... 1-48653

[51] Int. Cl.[5] ..... F04B 49/08

[52] U.S. Cl. ..... 417/310; 417/440; 62/324.6

[58] Field of Search ..... 417/292, 310, 440; 418/55.1; 62/324.6, 324.4, 196.3

[56] References Cited

U.S. PATENT DOCUMENTS

| | | | |
|---|---|---|---|
| 4,058,988 | 11/1977 | Shaw | 417/310 |
| 4,459,817 | 7/1984 | Inagaki . | |
| 4,505,651 | 3/1985 | Terauchi et al. | 418/55.1 |
| 4,621,986 | 11/1986 | Sudo | 417/310 |
| 4,702,088 | 10/1987 | Ozu | 62/324.6 |
| 4,715,793 | 12/1987 | Johann et al. | 417/310 |
| 4,717,314 | 1/1988 | Sato et al. | 417/310 |
| 4,744,733 | 5/1988 | Terauchi et al. | 418/55.1 |
| 4,823,758 | 4/1989 | Tamura et al. | 417/310 |
| 4,846,633 | 7/1989 | Suzuki et al. | 417/440 |
| 4,925,372 | 5/1990 | Hansen | 417/310 |

FOREIGN PATENT DOCUMENTS

| | | |
|---|---|---|
| 3301304 | 9/1983 | Fed. Rep. of Germany . |
| 3804418 | 10/1988 | Fed. Rep. of Germany . |
| 59-108896 | 10/1984 | Japan . |
| 2037965 | 7/1980 | United Kingdom . |

*Primary Examiner*—Leonard E. Smith
*Assistant Examiner*—Michael I. Kocharov
*Attorney, Agent, or Firm*—McAulay Fisher Nissen Goldberg & Kiel

[57] ABSTRACT

A compressor, e.g., a scroll type compressor for a heat pump including a bypass passage by way of which the high pressure side of the compressor is communicated with a compression chamber in which a compression stroke is carried out is disclosed. The compressor further includes opening/closing means so that when it is required that the compressor is operated at a high efficiency, the bypass passage is closed and when it is required that the compressor is operated with a high level of ability, the bypass passage is opened so as to allow high pressure gas to be introduced into the compression chamber in which a compression stroke is carried out whereby the gas is compressed again.

8 Claims, 5 Drawing Sheets

COMPRESSOR FOR HEAT PUMP AND METHOD OF OPERATING SAID COMPRESSOR

FIELD OF THE INVENTION AND RELATED ART STATEMENT

The present invention relates to a compressor incorporated in a heat pump for a heat pump type air conditioner or the like. Further, the present invention relates to a method of operating a compressor of the foregoing type.

FIG. 6 shows a circuit diagram for allowing a cooling medium for a conventional heat pump type air conditioner to recirculate through a circuit.

During a heating operation of the air conditioner, a high pressure/high temperature cooling medium gas discharged from a compressor 01 flows via a four-way valve 02 in a heat exchanger 03 installed inside of a room, as shown by arrow marks each accompanied by a dotted line. The cooling medium gas is condensed and liquidized in the heat exchanger 03 by radiating heat of the cooling medium gas into the interior of the room.

Thereafter, the high pressure liquidized cooling medium flows in an expansion valve 04 in which it is converted into a gas/liquid binary flow by its adiabatic expansion.

Next, the cooling medium flows in another heat exchanger 05 installed outside of the room in which it is converted into low temperature/low pressure gaseous cooling medium by its vaporization caused by absorbing heat from the outside air. Then, the cooling medium gas returns to the compressor 01 via the four-way valve 02 so as to circulate through the circuit again in the above-described manner.

On the other hand, during a cooling operation or a defrosting operation of the air conditioner, the cooling medium recirculates through the circuit via the compressor 01, the four-way valve 02, the heat exchanger 05 installed outside of the room, the expansion valve 04, the heat exchanger 03 installed inside of the room and the four-way valve 02 in an order of the above-noted components.

FIG. 7 shows a Moriere diagram which represents the above-described freezing cycle.

Here, in case where a power $P_i$ (Kcal/h) is inputted into the compressor 01, a cooling ability is represented by $\Delta i_1 \times G_r$ (Kcal/h) and a heating ability is represented by $\Delta i_2 \times G_r$ (Kcal/h). Where $\Delta i_1$ designates a differential enthalpy of the cooling medium before and after the vaporization in Kcal/h, $\Delta i_2$ designates a differential enthalpy of the cooling medium before and after the condensation in Kcal/h and $G_r$ designates a quantity of the cooling medium to be recirculated (Kg/h).

FIG. 8 is a vertical sectional view which illustrates by way of example the inner structure of the compressor 01.

The compressor 01 is constructed such that it includes a scroll type compressing mechanism C at the upper part of a closed housing 8, while it includes an electric motor 4 at the lower part of the same. The compressing mechanism c is operatively connected to the electric motor 4 via a rotational shaft 5.

Specifically, the scroll type compressing mechanism C includes a stationary scroll 1, a turnable scroll 2, a rotation inhibiting mechanism 3 for allowing turning movement of the turnable scroll 2 but inhibiting rotation of the turnable scroll 2 about an eccentric pin 53 to be described later, a frame 6, an upper bearing 71 for the rotational shaft 5, a lower bearing 71 for the rotational shaft 5, a bearing 73 for the turnable scroll 2 and a thrust bearing 74 as essential components.

The stationary scroll 1 comprises an end plate 11 and a plurality of spiral members 12. The end plate 11 has a discharge port 13 formed thereon and moreover it is provided with a discharge valve 17 for opening and closing the discharge port 13.

The turnable scroll 2 comprises an end plate 21 and a plurality of spiral members 22, and the end plate 21 has a boss 23 protruded therefrom.

A certain quantity of lubricant 81 is reserved on the bottom of a housing 8. The lubricant 81 is sucked up via an inlet port 51 at the lowermost end of a feed hole 52 in the rotational shaft 5 under the effect of a centrifugal force generated as the rotational shaft 5 is rotated, whereby the lower bearing 72, the eccentric pin 53, the upper bearing 71, the rotation inhibiting mechanism 3, the bearing 73, the thrust bearing 74 and other essential components are properly lubricated with the lubricant 81. After completion of the lubricating operation, the lubricant 81 flows down in the bottom part of the housing 8 via a chamber 61 and a drain hole 62.

As the compressor 01 is operated, a low temperature/low pressure cooling medium gas is introduced into the interior of the housing 8 via a suction port 82 and cools the electric motor 4. Thereafter, the cooling medium gas is introduced into the interior of a compression chamber 24 defined by the both spiral members 12 and 22 via a suction passage 15 and a suction chamber 16 on the stationary scroll 1. As the turnable scroll 2 is turned, a volume of the compression chamber 24 is reduced, causing the cooling medium gas to reach the central part while it is compressed. The compressed cooling medium gas raises up the discharge port 13 so that it is discharged into a discharge chamber 14 via the discharge port 13 and then it is discharged further through a discharge pipe 83. In FIG. 8, reference numeral 84 designates a balancing weight fastened to the top end of the rotational shaft 5.

However, with the compressor 01 as constructed in the above-described manner, when it is operated to achieve a higher operational efficiency, it has been found that there occurs a malfunction that an input into the compressor 01 is reduced to $P_{i'}$(Kcal/h) but a differential enthalpy $\Delta i_2$ of the cooling medium before and after condensation of the latter is reduced to $\Delta i_{2'}$ and thereby a heating ability $\Delta i_{2'} \times G_r$ (Kcal/h) is also reduced during a heating operation.

Incidentally, during a cooling operation, the compressor provides the same cooling ability 66 $i_1 \times G_r$ (Kcal/h) as that before operating the compressor to achieve a higher operational efficiency, resulting in a quantity of energy consumption being reduced.

OBJECT AND SUMMARY OF THE INVENTION

The present invention has been made to obviate such a malfunction that a heating ability is reduced when the foregoing conventional compressor is operated to achieve a higher operational efficiency, and its purport resides in providing a compressor for a heat pump, wherein the compressor is provided with a bypass passage by way of which the high pressure side of the compressor is communicated with a compression chamber in which a compression stroke is carried out and the compressor is further provided with opening/closing means for opening and closing the bypass passage.

Further, according to another aspect of the present invention, there is provided a method of operating a compressor for a heat pump, wherein during a cooling operation for which it is required that the compressor is operated at a high efficiency, a bypass passage is closed, the bypass passage being served such that discharge gas from the compressor is introduced into a compression chamber in which a compression stroke is carried out, and during a heating operation which requires a large heating ability, the bypass passage is opened so as to allow the compressor to be operated with a high level of ability.

With the compressor as constructed in the above-described manner, in case where it is operated at a high operational efficiency, the bypass passage is kept closed. In contrast with the foregoing case, when the compressor is operated with a high level of ability, the bypass passage is opened so that a high pressure gas is introduced into the compression chamber in which a compression stroke is carried out, whereby it is compressed again.

Consequently, when the bypass passage is closed during a cooling operation, the latter can be performed at a high efficiency. During a heating operation, at the time of starting the heating operation or during a defrosting operation in each which case a large heating ability is required, the bypass passage is opened, resulting in the heating ability being improved.

The bypass passage can be provided between a discharge chamber into which a discharge gas is introduced and the compression chamber in which a compression stroke is carried out.

The opening/closing means can be constructed in the form of a bypass piston adapted to be actuated by changing a control pressure.

Further, arrangement may be made such that the bypass passage is opened only when it is required that the compressor is operated with a high level of ability, e.g., at the time of starting the heating operation, during a defrosting operation or the like.

BRIEF DESCRIPTION OF THE DRAWINGS

FIG. 1 is a fragmentary sectional view of a compressor.

FIGS. 2 and 3 are an enlarged fragmentary sectional view of the compressor in FIG. 1, respectively, wherein FIG. 2 shows the compressor during a heating operation and FIG. 3 shows the compressor during a cooling operation.

FIG. 4 is a diagram illustrating variation of a volume of and a pressure in a compression chamber relative to an angle of rotation of a turnable scroll.

FIG. 5 is a diagram illustrating a relationship between a volume of and a pressure in the compression chamber.

DETAILED DESCRIPTION OF THE PREFERRED EMBODIMENT

Now, the present invention will be described in detail hereinafter with reference to the accompanying drawings which illustrate a preferred embodiment thereof.

Figure 1:
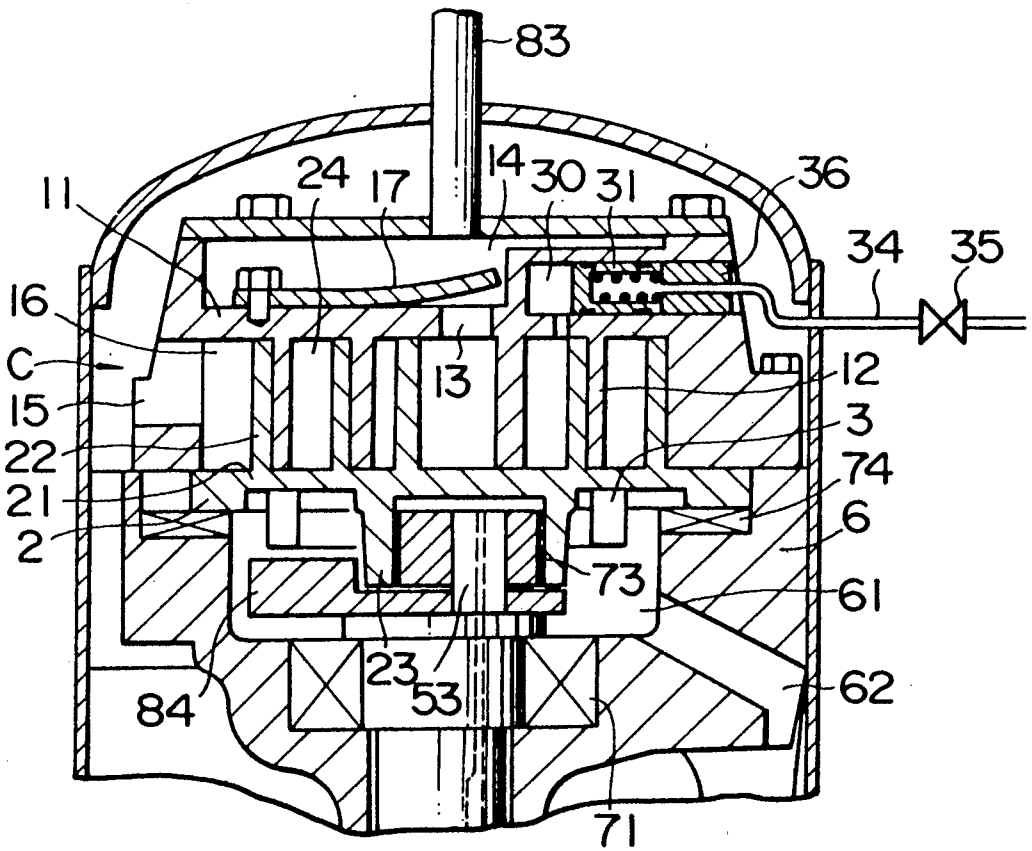
FIGS. 1 to 5 illustrate an embodiment of the present invention, respectively.
Figure 2:
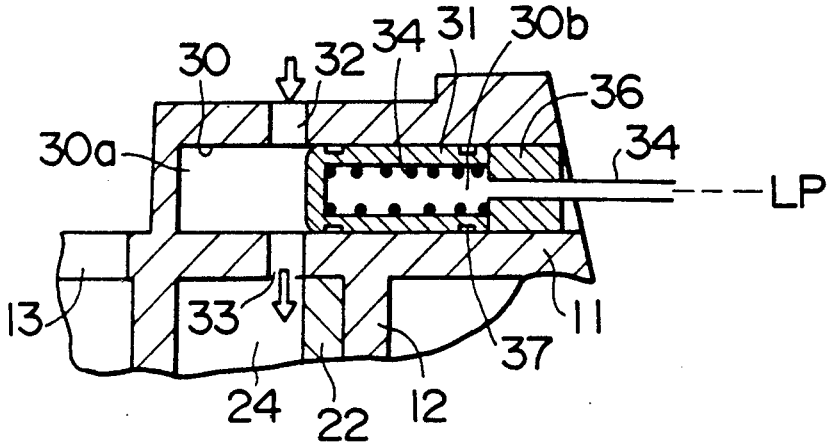
Figure 3:
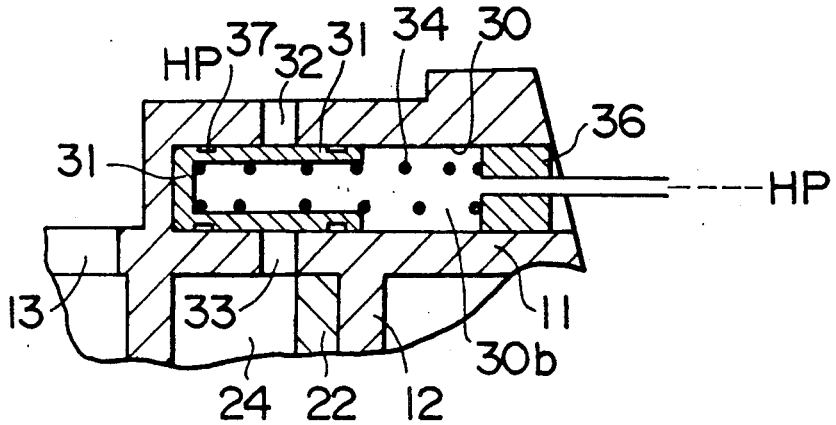

As shown in FIG. 1 to 3, a stationary scroll 1 includes an end plate 11 on which a cylinder 30 is installed. A slidable cup-shaped bypass piston 31 is sealably received in the cylinder 30. The cylinder 30 is formed with a hole 32 at its substantially central part by way of which a cylinder chamber 30*a* defined leftward of the bypass piston 31 is communicated with a discharge chamber 14. Further, the cylinder 30 is formed with a hole 33 by way of which the cylinder chamber 30*a* is communicated with a compression chamber 24 in which a compression stroke is carried out. The holes 32 and 33 and the cylinder chamber 30*a* a bypass passage by way of which the discharge chamber 14 is communicated with the compression chamber 24 in which a compression stroke is carried out in the shown state.

The cylinder 30 has a pressure input pipe 34 connected to the right end thereof which is communicated with a cylinder chamber 30*b* defined leftward of the bypass piston 31. A pressure controlling valve 35 is disposed midway of the pressure input pipe 34.

The bypass piston 31 is normally biased in the leftward direction by a coil spring 35 which is received in the cylinder chamber 30*b*.

Incidentally, reference numeral 36 designates a plug which defines the right end of the cylinder chamber 30*b* and reference numeral 37 designates a seal fitted round the bypass piston 31.

Figure 6:
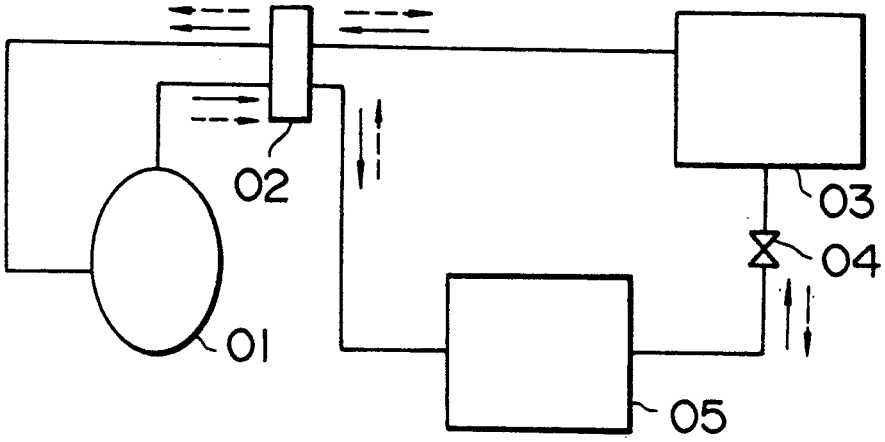
FIG. 6 PRIOR ART
FIG. 6 is a circuit diagram for cooling medium adapted to recirculate through a heat pump type air conditioner.
Figure 8:
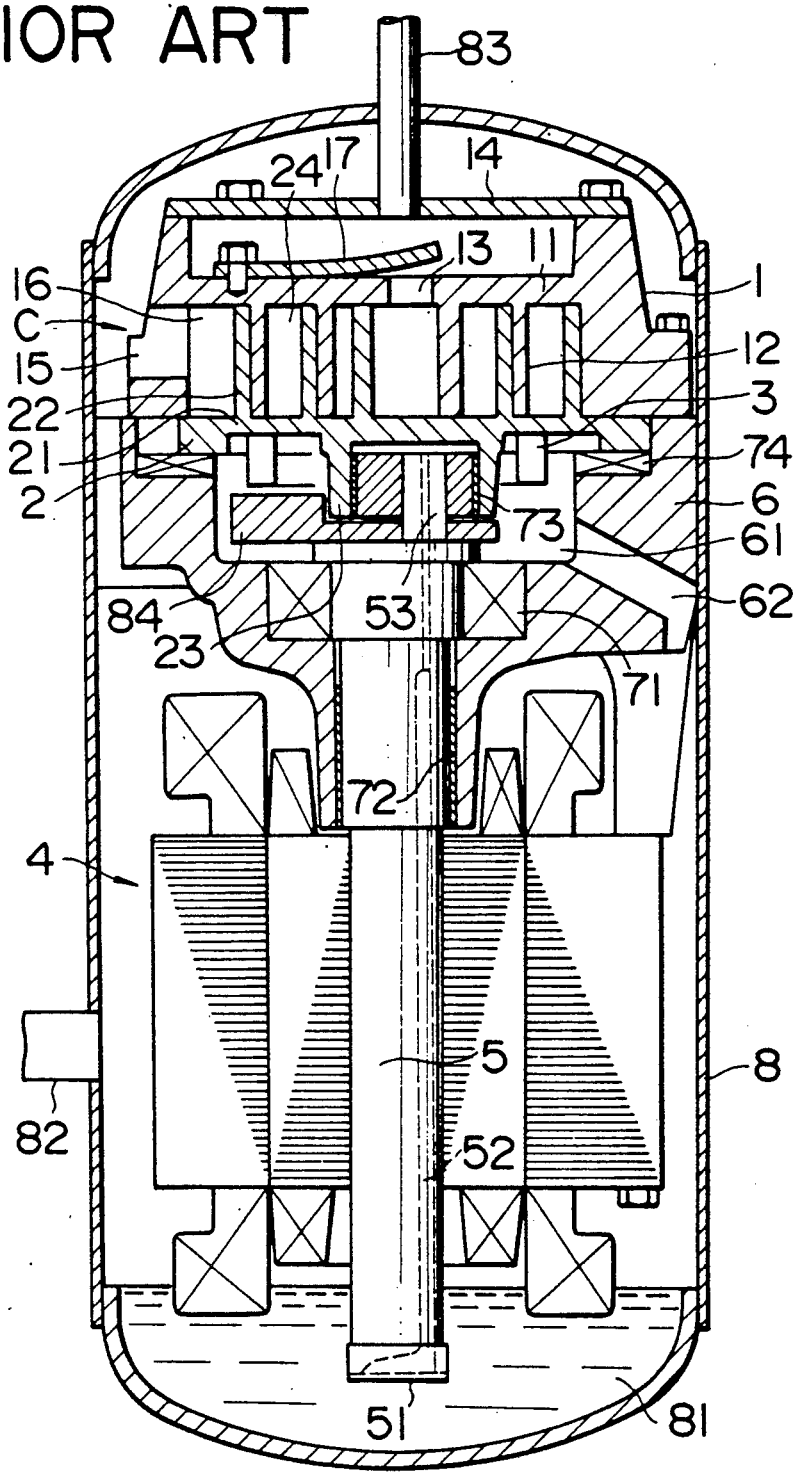
FIG. 8 PRIOR ART
FIG. 8 is a vertical sectional view of the conventional compressor.

Other structure rather than the aforementioned one is same to that of the conventional compressor as shown in FIGS. 6 and 8 and same or similar components as those in the drawings are represented by same reference numerals.

During a heating operation of the air conditioner, a low pressure LP generated by the compressor is transmitted to the cylinder chamber 30*b* via the pressure input pipe 34.

In response to transmission of the low pressure LP in that way, the bypass piston 34 is displaced in the rightward direction against a resilient force of the coil spring 34 under the effect of a suction force induced by the low pressure LP to reach the position as shown in FIGS. 1 and 2, whereby the holes 32 and 33 are opened and the bypass passage is then opened.

This causes discharge gas in the discharge chamber 14 to flow in the compression chamber 24 via the hole 32, the cylinder chamber 30*a* and the hole 33. It should be noted that a compression stroke is carried out in the compression chamber 24.

As a result, the pressure in the compression chamber 24 is increased and the discharge gas in the compression chamber 24 is compressed again so that a driving power for the compressor, i.e., an input into the compressor is increased.

On the other hand, during a cooling operation of the compressor, a high pressure HP generated by the compressor is transmitted to the cylinder chamber 30*b* via the pressure input pipe 34, as shown in FIG. 3.

In response to transmission of the high pressure HP, the bypass piston 31 is displaced in the leftward direction by the high pressure HP and the resilient force of the spring 34, whereby the holes 32 and 33 are closed and then communication through the bypass passage is interrupted.

This permits the compressor to be operated at a high normal efficiency.

Figure 4:
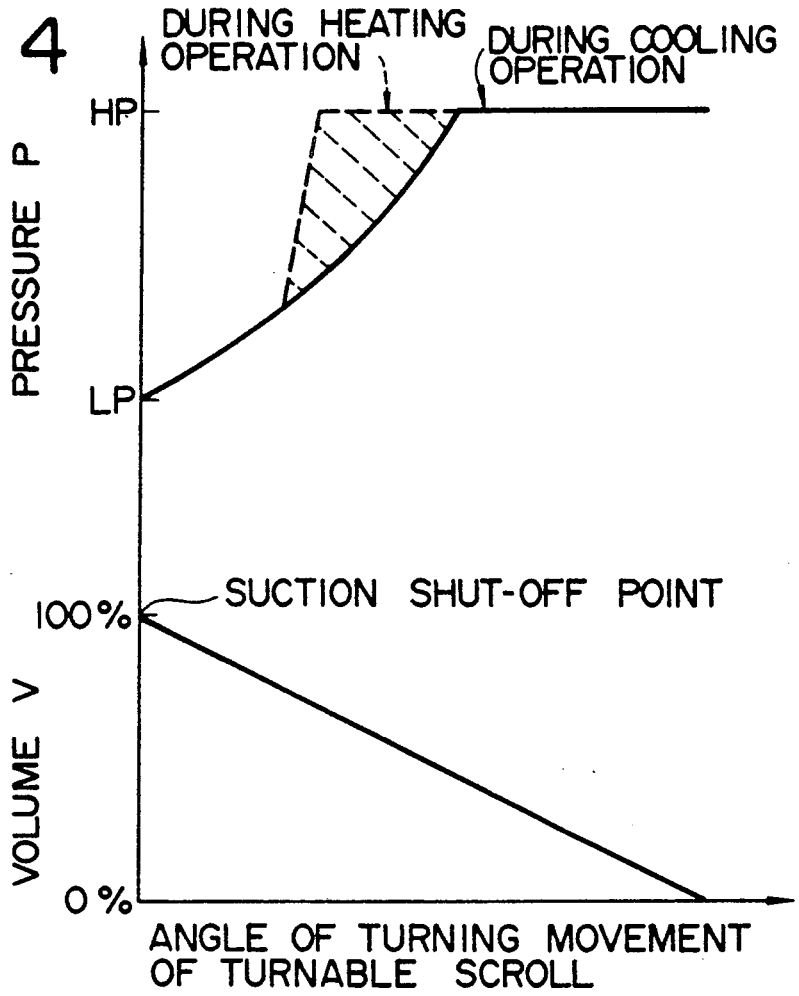
Figure 5:
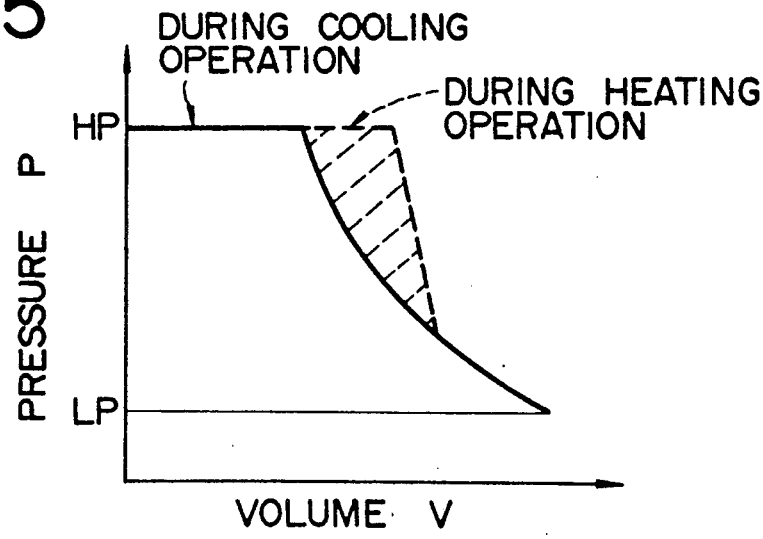

While the air conditioner performs a cooling operation, i.e., while communication through the bypass passage is kept interrupted, a volume of the compression chamber 24 decreases in proportion to increasing of a turning angle of the turnable scroll 2 after the latter passes past a suction shut-off point, as shown in FIG. 4. This causes a pressure in the compression chamber 24 to be increased, as shown by a solid line in the drawing. Then, an operation of the air conditioner is performed in accordance with a cycle as indicated by a solid line in FIG. 5 with the result that the compressor is operated at a high efficiency with a small quantity of input.

On the other hand, while the air conditioner performs a heating operation, i.e., while the bypass passage is kept opened, a discharge gas is introduced into the compression chamber 24 when the turnable scroll 2 reaches a point located midway of the compression stroke as shown in FIG. 4, whereby pressure in the compression chamber 24 varies as represented by a dotted line in the drawing. Then, an operation of the air conditioner is performed in accordance with a cycle as indicated by a dotted line in FIG. 5. Consequently, a work required for compression, i.e., a driving power required by the compressor increases by a quantity equal to an area shown by hatched lines in FIG. 5 much more than that during the cooling operation.

Figure 7:
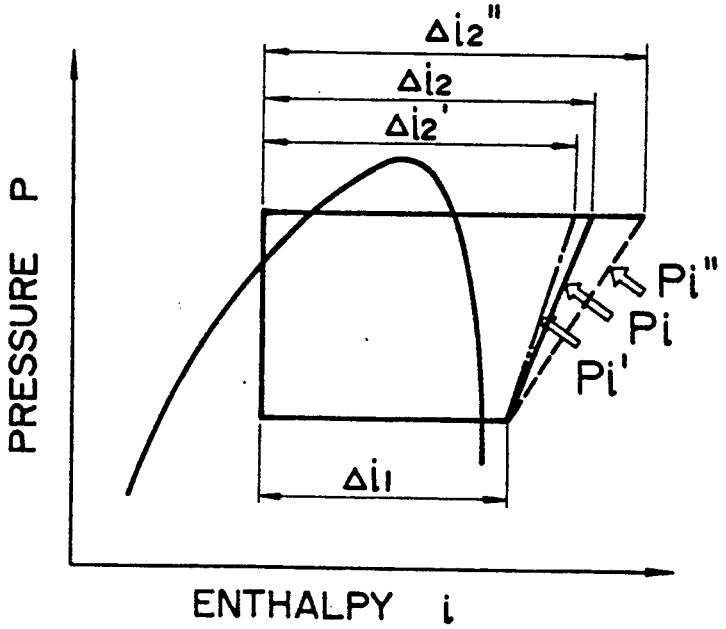
FIG. 7 PRIOR ART
FIG. 7 is a moriere diagram.

This behavior can be explained below with reference to a Moriere diagram in FIG. 7. Namely, during the heating operation of the compressor, an input into the compressor is represented by $P_{i''}$ (Kcal/h) and an ability of heating operation is represented by $\Delta i_{1''} \times G_r$ (Kcal/h).

On the other hand, during the cooling operation, an input into the compressor is represented by $P_{i'}$ (Kcal/h) and an ability of cooling operation is represented by $\Delta i_{2'} \times G_r$ (Kcal/h).

Incidentally, during the heating operation, the bypass passage is communicated with the compression chamber after the compressor passes past the suction shut-off point, whereby no discharge gas flows in the suction side. Accordingly, there is no fear that a volumetric efficiency of the compressor is degraded due to provision of the bypass passage.

In the above-described embodiment, the bypass passage is kept opened during the heating operation. Alternatively, the bypass passage may be opened only when it is required that an operation is performed with a high level of ability, e.g., at the time of starting the heating operation or during a defrosting operation.

Further, in the above-described embodiment, the bypass passage is opened or closed by the bypass piston. Alternatively, the bypass passage may be opened or closed using arbitrary means other than the bypass piston.

The present invention has been described above with respect to the case where it has been applied to a scroll type compression. However, the present invention should not be limited only to this. Alternatively, it may of course be applied to other type of compressor such as a rolling piston type compressor, a screw type compressor, a reciprocable piston type compressor or the like.

What is claimed is:

1. A method of operating a compressor for a heat pump, having a bypass passage between a discharge chamber and a compression chamber, and a valve positioned within said bypass passage, wherein during a cooling operation said bypass passage is closed, and during a heating operation said bypass passage is opened so as to allow a discharge gas to be introduced in to said compression chamber.

2. The method as claimed as in claim 1, wherein said bypass passage is opened only at the time of starting a heating operation.

3. A compressor for a heat pump, said compressor comprising:

a housing having a compression chamber in which a compression stroke is carried out, a discharge chamber defining the high pressure side of the compressor, and a bypass chamber provided between said discharge chamber and said compression chamber;

said bypass chamber formed with a passage having an open state and a closed state, said passage having one end communicating with said discharge chamber and another end communicating with said compression chamber to provide fluid communication therebetween;

valve means for opening and closing said bypass passage; and means for operating said compressor in either a cooling operation or a heating operation;

said bypass passage being closed during a cooling operation of said compressor, and said passage being open during a heating operation of said compressor;

wherein a discharge medium in said discharge chamber is introduced into said compression chamber through said bypass passage when said passage is open.

4. The compressor of claim 3, further comprising pressure control means for actuating said valve means.

5. The compressor of claim 3, wherein said passage is formed in a wall of said bypass chamber, and said valve means comprises a piston disposed for movement along said wall within said bypass chamber between a first position and a second position, said piston serving to open said bypass passage when in said first position and close said passage when in said second position, and further comprising pressure means generated by said compressor for actuating said piston valve.

6. The compressor of claim 3, wherein said bypass passage is opened by said valve means only at the start of a heating operation.

7. The compressor of claim 3, wherein said other end of said bypass passage communicates directly with said compression chamber thereby to introduce the discharge medium directly into said compression chamber when said passage is open.

8. A compressor for a heat pump, said compressor comprising:

a housing having a compression chamber in which a compressor stroke is carried out, a discharge chamber defining the high pressure side of the compressor, and a bypass chamber provided between said discharge chamber and said compression chamber;

said bypass chamber formed with a passage having an open state and a closed stage, said passage being formed in a wall of said bypass chamber and having one end communicating with said discharge chamber and another end communicating directly with said compression chamber to provide fluid communication therebetween;

valve means for opening and closing said bypass passage, said valve means comprising a piston disposed for movement along said wall within said bypass chamber between a first position and a second position, said piston serving to open said bypass passage when in said first position and close said passage when in said second position;

pressure means generated by said compressor for actuating said piston valve; and means for operating said compressor in either a cooling operation or a heating operation;

said bypass passage being closed during a cooling operation of said compressor, and said passage being open during a heating operation of said compressor;

wherein a discharge medium in said discharge chamber is introduced directly into said compression chamber through said bypass passage when said passage is open.

* * * * *